US005581237A

United States Patent [19]

DiPoala

[11] Patent Number: 5,581,237

[45] Date of Patent: Dec. 3, 1996

[54] MICROWAVE INTRUSION DETECTOR WITH THRESHOLD ADJUSTMENT IN RESPONSE TO PERIODIC SIGNALS

[75] Inventor: William S. DiPoala, Fairport, N.Y.

[73] Assignee: Detection Systems, Inc., Fairport, N.Y.

[21] Appl. No.: 329,604

[22] Filed: Oct. 26, 1994

[51] Int. Cl.[6] ..... G08B 13/18

[52] U.S. Cl. ..... 340/554; 340/541; 340/552; 340/573; 340/565; 342/99

[58] Field of Search ..... 340/554, 541, 340/552, 565, 573; 342/99

[56] References Cited

U.S. PATENT DOCUMENTS

| | | | |
|---|---|---|---|
| 4,090,195 | 5/1978 | Guennou et al. | 343/5 PD |
| 4,195,289 | 3/1980 | Cole | 340/554 |
| 4,197,537 | 4/1980 | Follen | 340/554 |
| 4,295,131 | 10/1981 | Bonori | 340/554 |
| 4,636,774 | 1/1987 | Gavin | 340/565 |
| 4,660,024 | 4/1987 | McMaster | 340/522 |
| 4,710,750 | 12/1987 | Johnson | 340/554 |
| 4,833,450 | 5/1989 | Buccola | 340/554 |
| 5,077,548 | 12/1991 | Diapola | 340/554 |
| 5,084,696 | 1/1992 | Guscott | 340/541 |
| 5,170,162 | 12/1992 | Fredericks | 340/554 |
| 5,196,826 | 3/1993 | Whiting | 340/554 |
| 5,276,427 | 1/1994 | Peterson | 340/565 |
| 5,331,308 | 7/1994 | Buccola | 340/554 |

*Primary Examiner*—Jeffery Hofsass
*Assistant Examiner*—Albert K. Wong
*Attorney, Agent, or Firm*—J. Addison Mathews

[57] ABSTRACT

A microwave intrusion detector is provided with a periodic signal detector that identifies periodic signals not typical of an intrusion and adjusts the alarm threshold in response such identification. The intrusion detector includes an adjustable threshold and a noise compensating circuit that actively adjusts the threshold at a first predetermined rate to mask background noise levels. The periodic signal detector modifies the adjustment, increasing the predetermined rate, when it detects a periodic signal typical of a motor, fan, florescent light or the like. The periodic signal detector also cancels or disables any pending or ongoing alarm to provide sufficient time for the threshold adjustments at the increased rate.

4 Claims, 3 Drawing Sheets

MICROWAVE INTRUSION DETECTOR WITH THRESHOLD ADJUSTMENT IN RESPONSE TO PERIODIC SIGNALS

BACKGROUND OF THE INVENTION

1. Field of Invention

The invention relates to microwave intrusion detectors, and more specifically to such detectors with adjustable alarm thresholds.

2. Description of the Prior Art

Intrusion detection systems based on microwave technologies typically include a Doppler signal detector directed toward a region under surveillance. The detector may include a microwave transceiver that transmits energy toward and receives reflected energy from the region. When the reflected energy is returned from a moving object, such as an intruder, it is shifted in frequency by a well known phenomena referred to as the Doppler effect. Mixing the returned energy with the transmitted energy produces a Doppler signal equal in frequency to the shift.

The Doppler signal is concentrated by amplification and filtering and is compared to a reference. Signals that exceed the reference are processed to reduce false alarms. Processed signals determined to represent valid alarms then activate appropriate annunciators and solenoids to warn of the intrusion.

As microwave detectors have become more sophisticated, features have been added to accommodate a variety of installation conditions. One such feature is a noise compensating circuit that actively adjusts the alarm threshold for the characteristics of a particular installation. The circuit typically includes a peak detector and an integrator having rise times and decay parameters that actively maintain the alarm threshold above Doppler signals caused by certain background activity. Signals from moving curtains, for example, increase the threshold, and are masked, without setting off the alarm.

PROBLEM SOLVED BY THE INVENTION

Noise compensating circuits actively balance desired high sensitivity against dreaded false alarms. It will become apparent from this description, however, that further improvements are possible, particularly in connection with the reduction of false alarms.

Although continuing repetitive disturbances may be tracked effectively by the alarm threshold, present devices may still alarm falsely when the disturbances first begin.

The rate of threshold adjustment is a parameter that is difficult to select for all circumstances. Under low noise conditions, for example, the adjustment rate should not be so fast that it masks the Doppler signal from an entering intruder. This requirement makes it very difficult and sometimes impossible to select an adjustment rate that tracks transient signals, such as starting motors, fans and florescent lights, without alarming.

SUMMARY OF THE INVENTION

The present invention is directed to overcoming one or more of the problems set forth above. Briefly summarized, according to one aspect of the invention, a microwave intrusion detector is provided with a periodic signal detector that identifies signals not typical of an intrusion and adjusts the alarm threshold in response to such identification. According to more specific features, the intrusion detector includes an adjustable threshold and a noise compensating circuit that actively adjusts the threshold to exceed a noise level. The periodic signal detector then modifies the adjustment when it detects a periodic signal. The noise compensating circuit adjusts the threshold at a first predetermined rate, and the periodic signal detector increases that predetermined rate when it identifies a periodic signal from a motor, fan, florescent light, or the like.

According to other features of the invention, the periodic signal detector cancels or disables an alarm to provide sufficient time for appropriate threshold adjustments when a periodic signal is detected.

The invention permits improved balance between the sensitivity and false alarm parameters mentioned above under a wide variety of circumstances. Noise signals from motors, fans and other periodic sources can be identified and handled differently. More aggressive corrections are possible when the signal is periodic and therefor atypical of an actual intrusion.

These and other features and advantages of the invention will be more clearly understood and appreciated from a review of the following detailed description of the preferred embodiments and appended claims, and by reference to the accompanying drawings.

DESCRIPTION OF THE PREFERRED EMBODIMENTS

Figure 1:
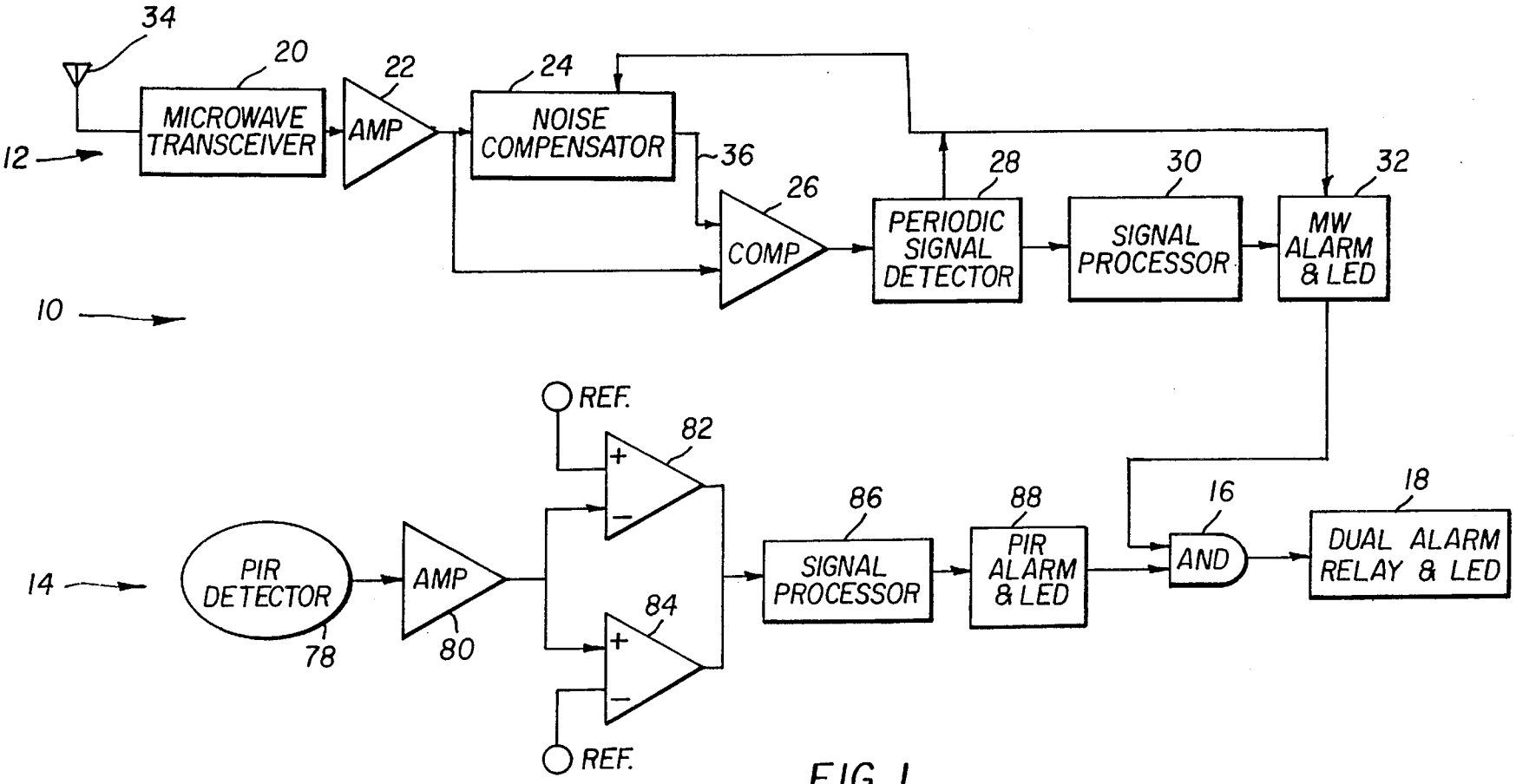
FIG. 1 is a block diagram of a dual technology intrusion detector with a microwave channel including a periodic signal detector according to the preferred embodiment of the invention.

Referring now to FIG. 1, a preferred embodiment of the invention is disclosed in a dual technology intrusion detection system 10. The preferred system includes a first or microwave channel 12, a second or infrared channel 14, AND gate 16, and a system alarm output 18.

Overview

Microwave channel 12 uses the Doppler effect for identifying an intrusion. A frequency shift is detected between transmitted and reflected energy caused by movement in the region under surveillance. The resulting signal is amplified, compared to a reference and processed to determine if it is characteristic of an intrusion. Infrared channel 14 uses heat. It detects infrared sources that stand out from the background and move in the region under surveillance. Again the signal is amplified, compared to references and processed to determine if it is characteristic of an intrusion. AND gate 16 initiates a system alarm signal, through output 18, when both channels detect signals characteristic of an intrusion within a predetermined time period. Output 18 then activates appropriate solenoids and annunciators to warn of the intrusion.

Microwave Channel

The microwave channel 12 includes transceiver 20, amplifier 22, noise compensator 24, comparator 26, periodic signal detector 28, signal processor or logic 30, and a microwave alarm and light emitting diode (LED) 32.

Transceiver 20 includes a radiating diode and appropriate driver for transmitting microwave energy at approximately ten and a half gigahertz (10.525 GHz). The energy is focused by antenna 34 and directed to the region under surveillance. Transceiver 20 also includes a mixing diode coupled to the antenna 34 for receiving energy reflected from the region under surveillance. The mixing diode detects frequency shifts or Doppler frequencies caused by movement in the region. The Doppler signal is approximately thirty one hertz for each mile per hour (31 Hz/MPH) of movement, and the mixing diode produces a time-varying output voltage having an amplitude and frequency proportional to the Doppler signal. A further description of microwave detectors is included in my commonly assigned U.S. Pat. No. 5,093,656, entitled Active Supervision of Motion-Detection Systems, issued Mar. 3, 1992, the disclosure of which hereby is incorporated by reference into the present specification.

Amplifier 22 is a band pass amplifier that amplifies Doppler frequencies from near zero to approximately fifty Hertz (50 Hz). The output of amplifier 22 is directed to noise compensating device 24 and is the signal input to comparator 26.

Noise compensating device 24 adjusts the reference threshold 36 to comparator 26 to a level that masks certain Doppler signals, such as moving curtains, that are not an intrusion. Such compensators, sometimes called noise riding circuits, are well known commercial devices that typically include a microprocessor equivalent of a peak detector in series with an integrator. The peak detector preferably has an instantaneous rise time, and a half volt per second (0.5 v/sec.) decay time. The integrator preferably has a rise time of nineteen and a half millivolts per second (19.5 mv/sec.) and a decay time of two tenths of a volt per second (0.2 v/s). The integrator starts to decay one and a half seconds (1.5 sec.) after the peak detector level falls below the integrator level. The output of the integrator follows the peaks of the Doppler signal at a rate depending on the rise and decay parameters noted above. A three tenths of a volt (0.3 v) offset is added to the integrator output, and this integrator output plus three tenths becomes the input 36 to comparator 26. Since the threshold changes over time, it is referred to here as an actively adjusted threshold.

The Doppler signal from amplifier 22 is compared to the threshold 36 by comparator 26. When it crosses the threshold, the comparator sends on output to periodic signal detector 28. If the Doppler signal is increasing when it crosses the threshold, the output signal from comparator 26 changes to one logical state, say from zero to one. If the Doppler signal is decreasing when it crosses the threshold, the output signal changes to another logical state, say from one to zero. Thus, the output of the comparator identifies whether the Doppler signal is above or below the threshold, and also when it crossed the threshold.

In the absence of a periodic signal, which will be described beginning in the next paragraph, signal processor 30 analyzes the pattern of threshold crossings to determine if they are characteristic of a valid alarm condition. A valid alarm requires three pulses, each remaining above the threshold for at least one millisecond, and the second and third pulses must cross the threshold within three seconds of the first crossing. If the three pulses occur within one and a half seconds, then a delay is added to provide one and a half seconds from the first pulse before the alarm signal is issued.

Periodic signal detector 28 detects periodic Doppler signals and initiates several actions when periodic signals are detected. It cancels any alarm signal in the microwave channel that may have been initiated by the periodic Doppler signal, it initiates changes in adjustments to the alarm threshold 36, and it temporarily disables further alarms until the alarm threshold changes have time to take effect. Periodic signals typically are produced by florescent lights, motor vibrations and fans, that do not represent an intrusion, but may have sufficient magnitude to exceed the threshold, particularly when they are first started. The periodic signal detector increases the rate at which the noise compensating circuit adjusts the alarm threshold, but only in response to Doppler signals that are not characteristic of an intrusion. An intruder, therefor, would not initiate the adjustment.

Figure 2:
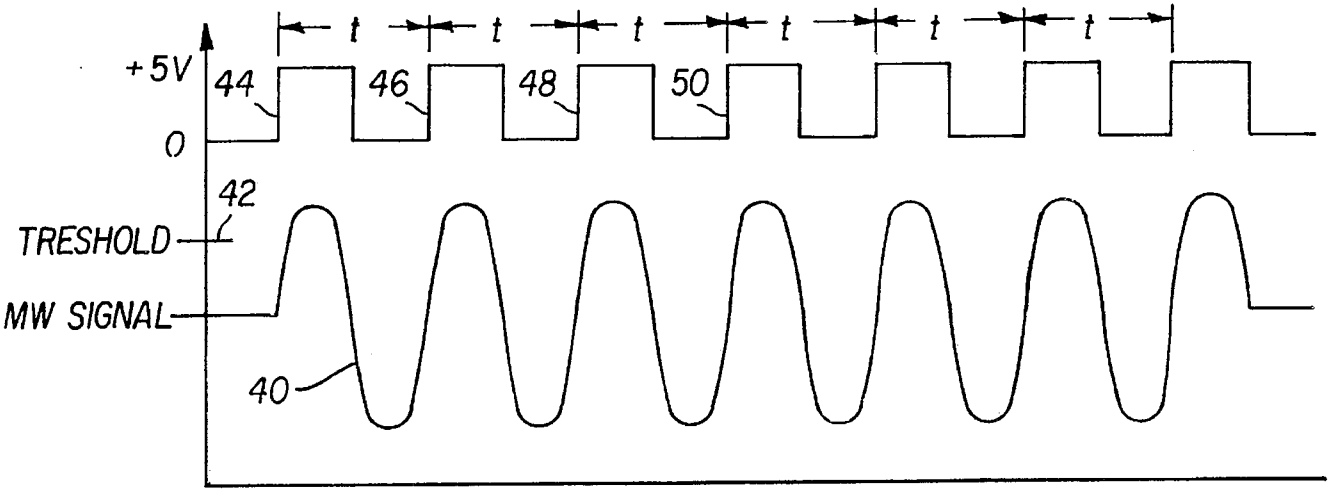
FIG. 2 is a representation of a periodic Doppler signal produced by the microwave detector of FIG. 1.

FIG. 2 represents a periodic signal 40 having leading or positive going transitions that cross threshold 42 at times 44, 46, 48, and 50. To be classified as a periodic signal, the time difference is compared between a current pair of leading edges, say 48 and 46, and the next prior pair of leading edges, 46 and 44. In this preferred embodiment, the time difference must not vary by more than plus or minus twelve percent (±12%), for fifteen consecutive pairs. Of course other variables might be employed, including plus or minus thirty percent (±30%) for five pairs.

Figure 3:
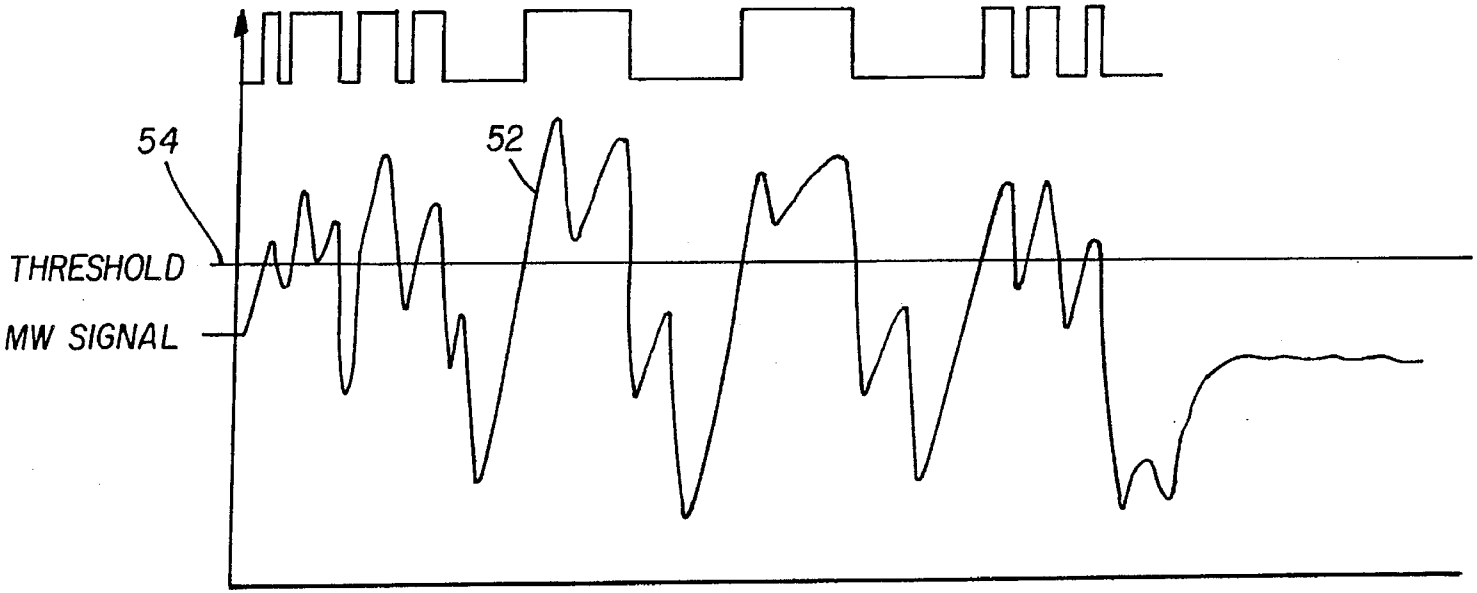
FIG. 3 is a representation of a non-periodic Doppler signal produced by the microwave detector of FIG. 1.

FIG. 3 represents an aperiodic signal 52 that might be produced by an intruder and that would not be identified by the periodic signal detector. The time between leading edge crossings of threshold 54 is highly variable.

Figure 4:
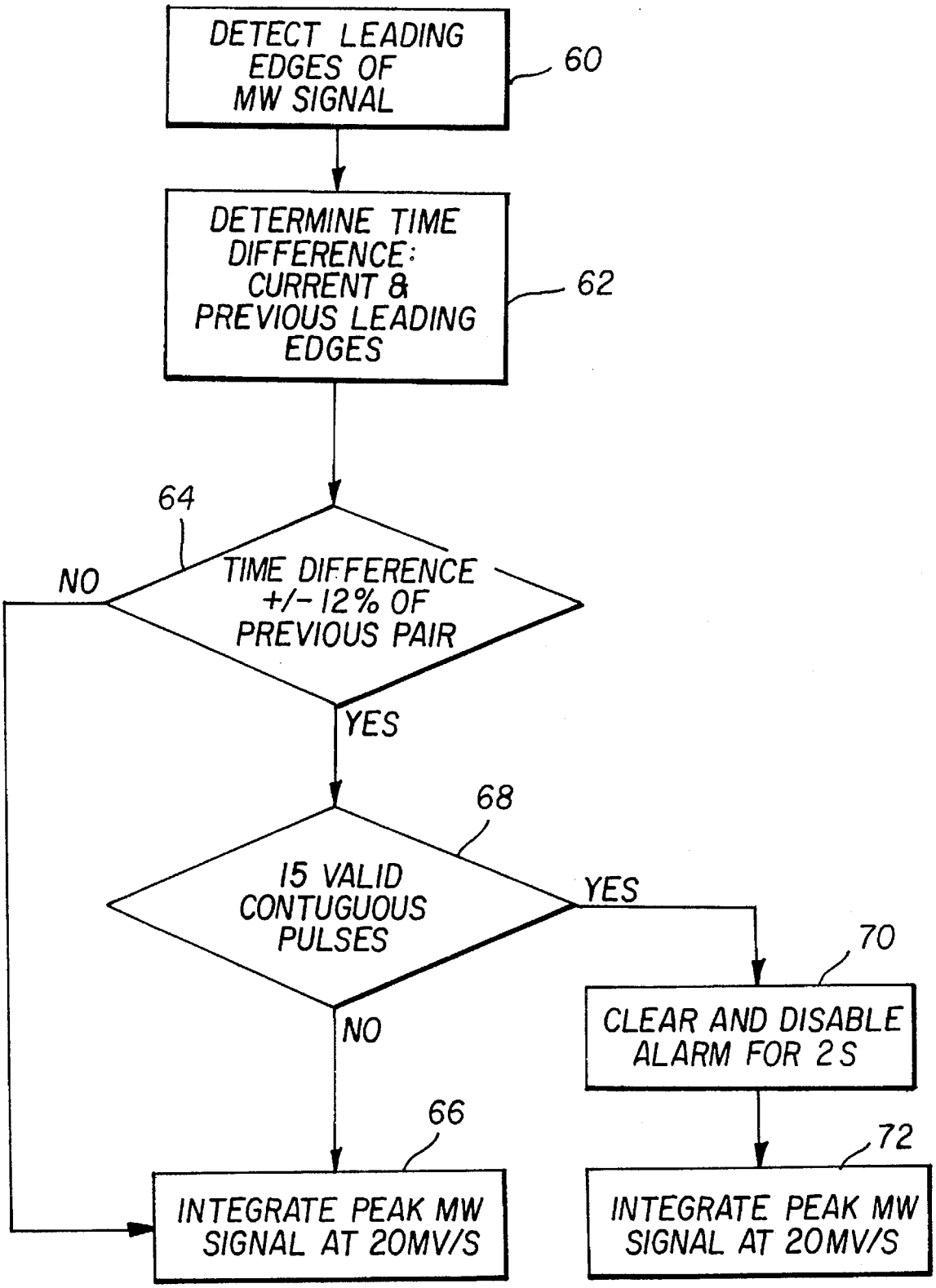
FIG. 4 is a flow diagram representing the operation of the periodic signal detector of FIG. 1.

FIG. 4 is a flow diagram depicting the operation of the periodic signal detector 28. Box 60 represents detection of an increasing Doppler signal when it crosses the alarm threshold. As previously mentioned, this causes a logic change at the output from comparator 26 as indicated at 44 on FIG. 2. Box 62 represents the comparison of the time difference between a current pair of leading edges, e.g. 48 and 46 in FIG. 2, and a previous pair of leading edges, e.g. 46 and 44 in FIG. 2. If the difference is greater than a predetermined standard considered indicative of a periodic signal, such as twelve percent, then there is no adjustment to the noise compensator 24 (see decision 64 and box 66). If, on the other hand, the difference is within the standard, the comparisons continue for a predetermined number of consecutive pairs, such as fifteen, considered appropriate for identifying a periodic signal, box 68. When a periodic signal is identified and confirmed, any pending or ongoing alarm is disabled and suspended for two seconds, and the rise time of noise compensator 24 is increased. In this preferred embodiment the increase is from twenty millivolts per second (20 mv/sec), to two volts per second (2 v/sec). The noise compensator 24 then increases, and has time to increase, the alarm threshold to mask the periodic noise source. Aperiodic signals, typical of those produced by an intruder, will not initiate the adjustment.

As mentioned briefly above, signal processor 30 processes the signals in the microwave channel, looking for parameters characteristic of an intrusion, while rejecting false and spurious signals. The processor reports valid microwave channel detection by issuing a single channel alarm signal and energizing a colored light emitting diode (LED) 32 located on the front of the detector where it is visible from the region under surveillance.

Infrared Channel

Infrared channel 14 includes a passive detector 78, amplifier 80, two comparators 82 and 84, signal processor 86, passive infrared (PIR) channel alarm and LED 88. Detector 78 is a pyroelectric device positioned at the focal point of an infrared optical system (not shown) having multiple fields of view in the region under surveillance. The detector 78 senses infrared sources that are hotter or colder than the background, and particularly movement of such sources across one or more fields of view. The output of detector 78 is a voltage which is amplified at 80, compared to positive and negative thresholds 82 and 84, and processed by signal processor 86. The processor again looks for amplitudes and other parameters characteristic of an intrusion, rejects false signals, and reports single channel detection by energizing LED 88. LED 88 is located adjacent LED 32, but is a different color, so the channel in alarm can be determined by the color of the energized LED.

Combined Channels And System Alarm

A system alarm requires alarms in both channels 12 and 14 within a predetermined time window. Dual detection is identified at AND gate 16, which issues a system alarm signal through relay and LED 18. Although a discrete component 16 has been disclosed, alternative approaches include microprocessors, as disclosed, for example, in my commonly assigned copending U.S. patent application Ser. No. 08/311,622, filed Sep. 23, 1994, and hereby incorporated by reference into the present specification.

It should now be apparent that the invention provides an relatively simple and inexpensive approach for recognizing patterns or signatures of certain noise sources in the microwave channel, and masking those patterns so they will not cause an alarm.

While the invention is described in connection with a preferred embodiment, other modifications and applications will occur to those skilled in the art. The claims should by interpreted to fairly cover all such modifications and applications within the true spirit and scope of the invention.

What is claimed is:

1. A microwave intrusion detector having an operating mode for detecting intruders in a region under surveillance, said intrusion detector comprising:

a source for directing microwave energy toward the region;

a Doppler signal detector for detecting Doppler signals from movement in said region and providing an output signal representing said detected Doppler signals;

means for comparing said output to an adjustable alarm threshold;

a noise compensating circuit for adjusting the alarm threshold to exceed a noise level; and, a periodic signal detector for detecting periodic signals in said output and modifying said threshold adjustment during said operating mode in response to said periodic signal detection;

wherein said noise compensating circuit adjusts said threshold at a first predetermined rate, and said periodic signal detector increases said rate in response to said periodic signal detection.

2. A microwave detector for detecting intrusion in a region under surveillance; said detector comprising:

a Doppler signal detector including a microwave transceiver mixing microwave energy transmitted toward and received from said region;

a comparator comparing Doppler signals detected by said Doppler signal detector to an adjustable threshold;

a periodic signal detector adjusting said threshold in response to detection of a periodic Doppler signal; and, a noise compensating circuit for adjusting the threshold to compensate for noise, said periodic signal detector modifying said noise compensating adjustment in response to said detection of said periodic signal;

wherein said noise compensating circuit adjusts said threshold at a first predetermined rate, and said periodic signal detector increases said rate in response to said periodic signal detection.

3. The invention of claim 2, wherein said intrusion detector issues an alarm signal in response to Doppler signals above said alarm threshold, and said periodic signal detector temporarily disables said issuance in response to said periodic signal detection.

4. A microwave intrusion detector comprising:

a source for directing microwave energy toward a region under surveillance;

a signal processor for detecting a Doppler signal from movement in said area, said signal processor issuing an alarm signal in response to said detection; and, a periodic signal detector coupled to said signal processor at least temporarily disabling said issuance of said alarm signal when said Doppler signal is periodic.

* * * * *